United States Patent [19]

Scott, Jr.

[11] 4,244,686

[45] Jan. 13, 1981

[54] ENERGY SAVING FURNACE AND METHOD OF OPERATING SAME

[75] Inventor: Wilmore S. Scott, Jr., Wilmington, N.C.

[73] Assignee: General Electric Company, San Jose, Calif.

[21] Appl. No.: 58,480

[22] Filed: Jul. 18, 1979

[51] Int. Cl.[3] ..... F27B 5/04

[52] U.S. Cl. ..... 432/26; 110/336; 264/65; 432/198

[58] Field of Search ..... 432/26, 29, 197, 198; 110/336; 431/7, 170; 264/65

[56] References Cited

U.S. PATENT DOCUMENTS

| | | | |
|---|---|---|---|
| 1,472,401 | 10/1923 | Roberts | 432/26 |
| 1,549,830 | 8/1925 | Haitm | 432/26 X |
| 2,992,147 | 7/1961 | Hays | 148/16 |
| 3,198,503 | 8/1965 | Eichelberg et al. | 432/198 X |
| 3,460,816 | 8/1969 | Miller | 432/198 |
| 3,515,380 | 8/1968 | Lazaridis | 432/198 |
| 3,930,787 | 1/1976 | DeHollander | 432/198 |

*Primary Examiner*—Edward G. Favors

*Attorney, Agent, or Firm*—Ivor J. James, Jr.; Raymond G. Simkins; Samuel E. Turner

[57] ABSTRACT

This disclosure relates to a distinctive construction and method of operating a furnace or oven for controlled atmosphere service whereby substantial savings in heating power or energy are realized. The furnace or oven includes a combination of refractory and insulating materials arranged in a given sequence with respect to their relative gas permeabilities, and at least two gases of discernably different weights are strategically supplied to the furnace or oven at particular locations therein.

22 Claims, 2 Drawing Figures.

ENERGY SAVING FURNACE AND METHOD OF OPERATING SAME

BACKGROUND

This invention relates to industrial type heating devices such as heat treating or sintering furnaces, ovens or kilns operating with a controlled gaseous atmosphere therein, and comprises a novel construction therefor and method of operating such a heating unit. The furnace or oven, etc., construction, and method of operation of this invention, provide substantial savings in the energy or power needs to effectively heat and operate controlled atmosphere heating devices.

Heat treating, sintering and the like furnaces and ovens have traditionally been designed and constructed according to one of two established categories or systems. One type of furnace operates with the particular gas of the controlled atmosphere within the heating chamber simply extending or permeating throughout the entire cross-section of the complete unit, including occupying any areas beyond or external to the refractory walls providing the hot face of and defining the heating or sintering chamber area and reaching to the outer furnace housing which is generally of a substantially gas tight construction.

The other type of furnace or oven for controlled atmosphere service includes a gas tight muffle or shroud unit to contain and isolate the particular atmospheric gas within its confines defining the heating or sintering chamber area. The space external to the muffle or shroud unit, which usually includes the thermal insulation and heating means or elements, appropriately has an atmosphere of a gas that is compatable with any components such as the insulation and heating means located in the outer portions of a muffle furnace, and therefore can be different from the atmosphere within the muffle. Furnaces of this latter type comprising muffles or gas tight isolating enclosures are illustrated in U.S. Pat. Nos. 1,472,401 and 2,064,532.

Muffle type furnaces or ovens, however, are relatively expensive to construct and they frequently encounter difficulties with respect to their reliability under certain operating conditions, such as reaching and maintaining very high temperature levels that are often required for many contemporary manufacturing procedures.

BRIEF DESCRIPTION OF THE INVENTION

This invention relates to furnaces, ovens, or kilns of the non-muffle or ordinary type, for controlled atmosphere service utilizing a relatively light weight gas or gases, for example, hydrogen, helium or ammonia, as the atmosphere, and the invention comprises a means of substantially reducing heat losses that are attributable to operating this type of furnace with such light gases. The furnaces or ovens of this invention contain a composite of refractory and insulating components or materials arranged to define and sheath the heating chamber or area, with each of said components or materials disposed with respect to each other in a layered sequence determined by their relative gas permeability so as to provide an effective low permeability barrier to the flow of gas and the transfer of heat thereby. Also, in addition to the gas normally provided to supply the controlled atmosphere in the heating chamber or area of such furnaces, a second gas of relatively heavier weight than said primary gas of the heating chamber atmosphere is applied in the practice of this invention to the cold or outer side of the composite of refractory and insulating components or materials constituting the sheathing covering the heating chamber, or to the area adjoining the same, and at a pressure greater than the pressure of the gas provided for the atmosphere in the heating chamber.

OBJECT OF THE INVENTION

It is a primary object of this invention to realize maximum savings in energy expenditures and costs of operating or supplying heat to controlled atmosphere heating devices without incurring any impairment in performance.

Another object of this invention is to reduce heat losses and enhance thermal efficiency in controlled atmosphere furnaces, ovens, kilns, and the like, by means of a system of combining conventional refractory and insulating materials in a sequenced arrangement with respect to their degree or level of gas permeability and offsetting any possible migration of the atmosphere gas therethrough with the counter directed application of a second gas of higher weight and under greater pressure.

Other objects and advantages of this invention will become apparent to those skilled in this art as the description and illustration of the invention proceeds.

The present invention will be more readily understood by reference to the following detailed description which includes reference to the accompanying drawings.

DETAILED DESCRIPTION OF THE INVENTION

Figure 1:
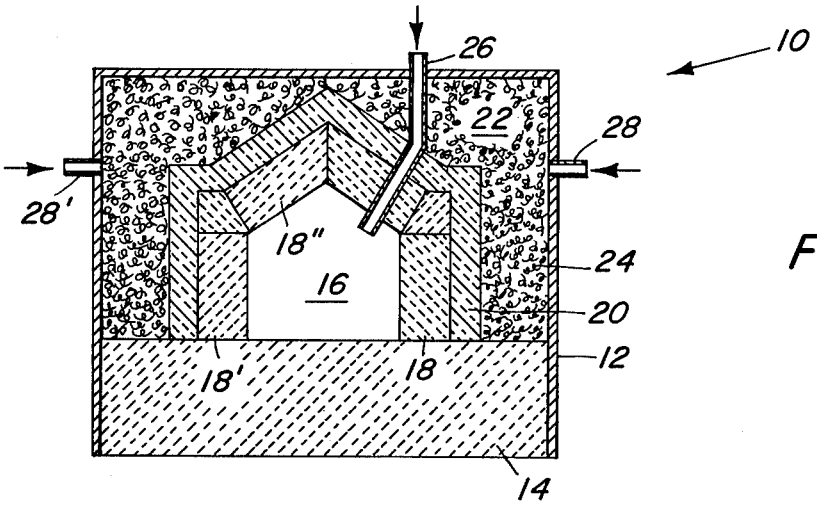
FIG. 1 comprises a diagrammatic cross section of a construction for a furnace of this invention; and, FIG. 2 comprises a cross sectional view of one embodiment for a furnace construction of this invention.

Referring to the drawings, and in particular FIG. 1, the furnace 10 comprises an enclosing housing 12, a base or foundation unit 14 of one or more units of high temperature resisting ceramic type of refractories, and walls 18, such as side walls 18–18' and top wall 18'', defining the heating chamber or area 16, and providing the hot face thereof. The furnace housing 12 is typically constructed of steel or other apt heat resisting metal, and is normally of a substantially gas tight construction. Walls 18 et seq. defining the heating chamber 16 and providing the hot face thereof are constructed of a suitable ceramic refractory of appropriate temperature resistance for the designed service, such as commercial fire brick or blocks. Typical high temperature resistant ceramic refractories exhibit some gas permeability.

A sheathing 20 comprising at least one body or layer of high temperature refractory or insulating material, and preferably a composite of a combination of such materials, surrounds and covers at least a substantial portion of the outer or cold surface of the walls 18 et seq. defining the furnace heating chamber 16. The sheathing 20, or the components thereof, must have at least some degree of gas permeability to permit a limited transfer of gas therethrough. However, gas impermeable metals can be used or included in the sheath 20, provided that seams, joints or other openings therein are provided in the metal component in a manner to enable the passage of gas therethrough.

Nevertheless, the sheathing 20, or at least one component thereof, should be of a relatively low level of gas permeability so that it provides an effective low permeability barrier impeding any substantial or rapid flow or migration of gas therethrough and in turn transfer of heat thereby.

High temperature resisting refractory and insulating materials suitable for the sheathing 20, either alone or combined with other components or materials, comprise conventional or commercially available ceramic refractory fire brick or slabs, and insulating fire brick or slabs, metal oxides such as zirconia or alumina in various physical forms such as board or blocks of various porosities, and even high temperature metals such as molybdenum and chrome-nickel alloys. The refractory or insulating materials used, their dimensions, number thereof employed and combinations or arrangements, are each determined by the operating temperatures for a given furnace or service, space limitations and the like practical considerations unique to each situation or installation.

The furnace heating chamber 16 defined by the walls 18 et seq. and the sheathing 20 covering the walls 18 are all positioned within the furnace housing 12 and in a spaced apart relation therewith to thereby provide an intermediate space 22 between the housing 12 and the sheathing 20 covering the heating chamber walls 18.

Intermediate space or spaces 22 are provided with a very low density or highly porous, high temperature insulation 24 such as alumina or alumina-silica fibers or particles. Such a particulate and highly porous material as insulating fibers or granules provides a very high degree of gas permeability and little resistance to gas movement and flow therethrough.

Heating means for the heating chamber or area 16 can comprise any convention system or device and therefore are not shown in the drawing. For instance, the heat source can comprise electrical resistance heaters such as commercial Calrod units, or for higher temperatures, molybdenum resistance heating units. Heating units or elements can be affixed or mounted on the top or side walls inside the heating chamber or area 16, or at other appropriate locations therein.

Heating chamber or area 16 includes means for providing and maintaining a controlled atmosphere of a particular gas within the heating chamber area 16, such as conduit 26 connecting the chamber area 16 with a source of an appropriate gas, such as hydrogen or helium. Means can also be provided (not shown) for exhausting the atmospheric gas or gases and either capturing it for reuse or burning if a combustible gas is used.

In accordance with this invention, intermediate space or spaces 22 containing a highly porous insulation 24, is provided with a connection, such as conduit 28, to a source of a gas of a relatively greater weight than the gas providing the atmosphere within the heating chamber area 16 through conduit 26. Moreover, means are provided, such as pressure gauges and valves in such conduits, to feed the relatively heavier weight gas into the intermediate space or spaces 22 at a pressure greater than the pressure of the relatively lighter weight gas within the heating chamber area 12.

Pursuant to the method of this invention for operating a furnace or heating device for controlled atmosphere service with improved energy or power efficiency, in addition to the usual provision and maintenance of the controlled atmosphere within the heating chamber area by continuously supplying an appropriate gas to said area from a supply thereof through conduit 26, a second gas is also fed into the furnace 10. The second gas is supplied to the furnace 10 by introducing it through conduit 28 into the intermediate space or spaces 22, between the furnace housing 12 and the sheathing 20 on walls 18, and containing the highly porous insulating material 24.

The second gas must be of a relatively heavier weight than the primary gas supplying the controlled atmosphere within the heating chamber area 16 through conduit 26. Additionally the second and heavier gas must be introduced into the furnace 10 at a pressure greater than the pressure of introduction of the primary or heating chamber atmosphere gas.

Figure 2:
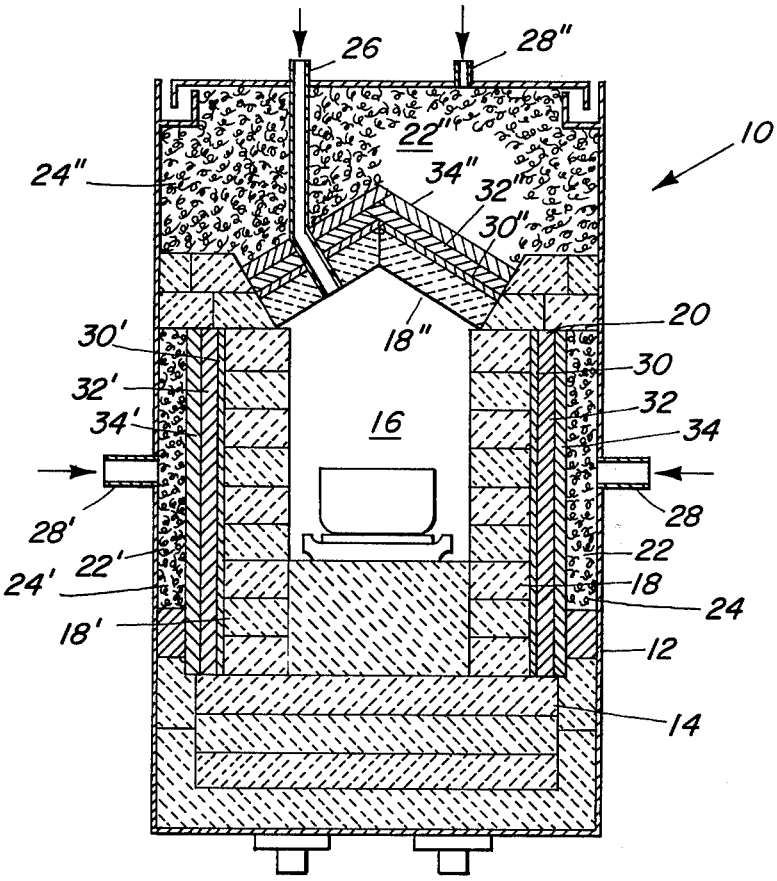

FIG. 2 illustrates a specific working embodiment of this invention in detail, comprising a controlled atmosphere sintering furnace 10, having a steel housing 12 and refractory block foundation 14, and refractory brick side walls 18–18' and top wall 18'' defining the heating chamber 16 and forming the hot face thereof. The refractory brick of the heating chamber walls consists of 4.5 inch thick bubble alumina brick (NORTON AN599).

In the instant embodiment, the sheathing 20 surrounding and covering the outer or cold surface of walls 18 et seq. defining the furnace heating chamber 16, comprises a composite of several high temperature resistant refractory and insulating materials, including some of relatively low gas permeability. Sheathing 20 of this embodiment of the invention includes a layer 30–30'–30'' consisting of 0.010 inch thick sheets of molybdenum metal adjoining the cold outer surface of walls 18 of the heating chamber 16, then a layer 32–32'–32'' consisting of a one inch thick fibrous insulating board of zirconia (ZIRCAR Products 2YF B3), followed by a layer 34–34'–34'' of a one inch thick insulating board of alumina (RIM Products A A20).

Spaces 22–22'–22'' intermediate the furnace housing 12 and the sheathing 20, are filled and packed to a density of about 7 pounds per cubic foot with an insulation of refractory alumina fiber or "wool" (SAFFIL Alumina HT fiber).

The furnace was provided with molybdenum electrical resistance heaters suspended from the top wall 18'' defining the heating chamber 16.

The above described controlled atmosphere sintering furnace comprising a specific working embodiment was used to evaluate the effects of this invention employing alumina bricks as sample goods for sintering, and a controlled atmosphere of dissociated ammonia within the heating chamber area 16 supplied through conduit 26. The addition of a second and heavier gas, in this case nitrogen, at a slightly higher pressure than the supply of ammonia, to the spaces 22 intermediate the housing and sheathing, resulted in an 18% reduction in electrical power consumption by the furnace over that of its operation under identical conditions except for the use of the second gas, nitrogen.

Potentially suitable light weight gases for the controlled atmosphere service comprise hydrogen, helium, methane, and ammonia, whereas potentially suitable heavier weight gases for the practice of this invention include nitrogen, carbon monoxide, carbon dioxide, neon, argon, krypton, xenon and radon, or mixtures thereof.

What is claimed is:

1. A furnace of improved operating economy for controlled atmosphere service, comprising:

(a) a heating chamber having walls of a gas permeable refractory material providing at least a portion of the hot face of said chamber;

(b) a substantially gas impervious furnace housing enclosing at least a portion of the heating chamber in a spaced apart relation with the gas permeable walls thereof to thereby provide an intermediate space therebetween;

(c) a highly porous thermal insulating material positioned in the space intermediate said furnace housing and gas permeable walls of the heating chamber;

(d) means for supplying a relatively light weight gas into the heating chamber; and, (e) means for supplying a relatively heavy weight gas into the space intermediate said furnace housing and gas permeable walls of the heating chamber at a pressure greater than the pressure of the relatively lighter weight gas within the heating chamber.

2. A furnace of improved operating economy for controlled atmosphere service, comprising:

(a) a heating chamber having walls of a gas permeable refractory material providing at least a portion of the hot face of said chamber defining a heating area;

(b) a sheathing comprising a relatively low gas permeable material covering at least a portion of the cold outer surface of said walls of gas permeable refractory material defining the heating chamber area;

(c) a substantially gas impervious furnace housing enclosing at least a portion of the heating chamber in a spaced apart relation with the sheathed gas permeable walls thereof to thereby provide an intermediate space therebetween;

(d) a highly porous thermal insulating material positioned in the space intermediate said furnace housing and sheathed gas permeable walls of the heating chamber;

(e) means for supplying a relatively light weight gas into the heating area of the heating chamber; and, (f) means for supplying a relatively heavy weight gas into the space intermediate said furnace housing and sheathed gas permeable walls of the heating area of the heating chamber at a pressure greater than the pressure of the relatively lighter weight gas within the heating chamber area.

3. A furnace of improved operating economy for controlled atmosphere service, comprising:

(a) a heating chamber having walls of a gas permeable refractory ceramic providing at least a substantial portion of the hot face of said chamber defining a heating area of the furnace;

(b) a heat resistant sheathing comprising a relatively low gas permeable material covering at least a portion of the cold outer surface of said walls of gas permeable refractory ceramic defining the heating chamber area;

(c) a substantially gas impervious furnace housing enclosing at least a portion of the heating chamber in a spaced apart relation with the sheathed gas permeable walls thereof to thereby provide an intermediate space therebetween;

(d) a highly porous particulate thermal insulating material positioned in the space intermediate said furnace housing and sheathed gas permeable walls of the heating chamber;

(e) means for supplying a relatively light weight gas into the heating area of the heating chamber to provide an atmosphere therein; and, (f) means for supplying a relatively heavy weight gas into the space intermediate said furnace housing and sheathed gas permeable walls of the heating area of the heating chamber at a pressure greater than the pressure of the relatively lighter weight gas providing an atmosphere within the heating chamber area.

4. The furnace of claim 3, wherein the sheathing comprising a relatively low gas permeable material includes a plurality of layers of refractory materials.

5. The furnace of claim 3, wherein the gas permeable refractory ceramic of the heating chamber walls comprises fire brick.

6. The furnace of claim 3, wherein the sheathing comprising a relatively low gas permeable material includes a thin sheet of metal.

7. The furnace of claim 6, wherein the thin sheet of metal included in the sheathing comprises molybdenum.

8. The furnace of claim 6, wherein the sheathing comprising a relatively low gas permeability material includes a layer of zirconia.

9. The furnace of claim 6, wherein the sheathing comprising a relatively low gas permeability material includes a a layer of alumina.

10. A furnace of improved operating economy for controlled atmosphere service, comprising:

(a) a heating chamber having walls of a gas permeable refractory ceramic providing at least a substantial portion of the hot face of said chamber defining a heating area of the furnace;

(b) a sheathing barrier comprising a relatively low gas permeable material covering at least a portion of the cold outer surface of said walls of gas permeable refractory ceramic defining the heating chamber area, said sheathing barrier including a thin sheet of molybdenum adjoining the cold outer surface of the walls of the heating chamber area, a layer of zirconia adjoining sheet of molybdenum, and a layer of alumina adjoining the sheet of molybdenum;

(c) a substantially gas impervious furnace housing enclosing at least a portion of the heating chamber in a spaced apart relation with the sheathed gas permeable walls thereof to thereby provide an intermediate space therebetween;

(d) a highly porous particulate thermal insulating material positioned in the space intermediate said furnace housing and sheathed gas permeable walls of the heating chamber;

(e) means for supplying a relatively light weight gas into the heating area of the heating chamber to provide an atmosphere therein of said gas; and, (f) means for supplying a relatively heavy weight gas into the space intermediate said furnace housing and sheathed gas permeable walls of the heating area of the heating chamber at a pressure greater than the pressure of the relatively lighter weight gas providing an atmosphere within the heating chamber area.

11. A method of improving the operating economy of a furnace for controlled atmosphere service, comprising the steps of:

(a) providing a heating chamber for a furnace with walls of a gas permeable refractory material forming at least a portion of the hot face of said heating chamber;

(b) providing means for supplying heat to said furnace heating chamber;

(c) providing a substantially gas impervious furnace housing enclosing at least a portion of the heating chamber in a spaced apart relation with the gas permeable walls thereof to thereby provide an intermediate space therebetween;

(d) providing a highly porous thermal insulating material positioned in the space intermediate said furnace housing and gas permeable walls of the heating chamber;

(e) supplying a relatively light weight gas into the heating chamber; and, (f) supplying a relatively heavy weight gas into the space intermediate said furnace housing and gas permeable walls of the heating chamber at a pressure greater than the pressure of the relatively lighter weight gas within the heating chamber.

12. The method of claim 11, wherein the relatively light weight gas supplied into the heating chamber is selected from the group consisting of hydrogen, helium and ammonia, and mixtures thereof, and the relatively heavy weight gas supplied into the space intermediate said furnace housing and gas permeable walls at the heating chamber is selected from the group consisting of nitrogen, carbon monoxide, carbon dioxide, neon, argon, krypton, xenon and radon, and mixtures thereof.

13. A method of improving the operating economy of a furnace for controlled atmosphere service, comprising the steps of:

(a) providing a heating chamber having walls of a gas impervious refractory material forming at least a portion of the hot face of said chamber defining a heating area;

(b) providing means for supplying heat to said furnace heating chamber area;

(c) providing a sheathing comprising a relatively low gas permeable material covering at least a portion of the cold outer surface of said walls of gas permeable refractory material defining the heating chamber area;

(d) providing a substantially gas impervious furnace housing enclosing at least a portion of the heating chamber in a spaced apart relation with the sheathed gas permeable walls thereof to thereby provide an intermediate space therebetween;

(e) providing a highly porous thermal insulating material positioned in the space intermediate said furnace housing and sheathed gas permeable walls of the heating chamber;

(f) supplying a relatively light weight gas into the heating area of the heating chamber; and, (g) supplying a relatively heavy weight gas into the space intermediate said furnace housing and sheathed gas permeable walls of the heating chamber at a pressure greater than the pressure of the relatively lighter weight gas within the heating chamber area.

14. A method of improving the operating economy of a furnace for controlled atmosphere service, comprising the steps of:

(a) providing a heating chamber having walls of a gas permeable refractory ceramic forming at least a substantial portion of the hot face of said chamber defining a heating area of the furnace;

(b) providing means for supplying heat to said furnace heating chamber area;

(c) providing a heat resistant sheathing comprising a relatively low gas permeability material covering at least a portion of the cold outer surface of said walls of gas permeable refractory ceramic defining the heating chamber area;

(d) providing a substantially gas impervious furnace housing enclosing at least a portion of the heating chamber in a spaced apart relation with the sheathed gas permeable walls thereof to thereby provide an intermediate space therebetween;

(e) providing a highly porous particulate thermal insulating material positioned in the space intermediate said furnace housing and sheathed gas permeable walls of the heating chamber;

(f) supplying a relatively light weight gas into the heating area of the heating chamber to provide an atmosphere therein; and, (g) supplying a relatively heavy weight gas into the space intermediate said furnace housing and sheathed gas permeable walls of the heating chamber at a pressure grearter than the pressure of the relatively lighter weight gas within the heating chamber area.

15. The method of claim 14, comprising providing the sheathing comprising a relatively low gas permeable material covering at least a portion of the cold outer surface of the walls of the heating chamber area with a plurality of layers of refractory materials.

16. The method of claim 14, comprising forming the gas permeable refractory ceramic of the heating chamber walls with fire brick.

17. The method of claim 14, comprising providing the sheathing comprising a relatively low gas permeability material with a thin sheet of metal covering at least a portion of the cold outer surface of the walls of the heating chamber area.

18. The method of claim 17, comprising providing the sheathing comprising a relatively low gas permeability material with a thin sheet of molybdenum covering at least a portion of the cold outer surface of the walls of the heating chamber area.

19. The method of claim 17, comprising providing the sheathing comprising a relatively low gas permeability material with a layer of zirconia covering at least a portion of the cold outer surface of the walls of the heating chamber area.

20. The method of claim 17, comprising providing the sheathing comprising a relatively low gas permeability material with a layer of alumina covering at least a portion of the cold outer surface of the walls of the heating chamber area.

21. A method of improving the operating economy of a furnace for controlled atmosphere service, comprising the steps of:

(a) providing a heating chamber having walls of a gas permeable refractory ceramic forming at least a substantial portion of the hot face of said chamber defining a heating area of the furnace;

(b) providing means for supplying heat to said furnace heating chamber area;

(c) providing a sheathing barrier comprising a relatively low gas permeability material covering at least a portion of the cold outer surface of said walls of gas permeable refractory ceramics defining the heating chamber area, said provided sheathing barrier including a thin sheet of molybdenum adjoining the cold outer surface of the walls of the heating chamber area, a layer of zirconia adjoining the sheet of molybdenum, and a layer of alumina adjoining the sheet of molybdenum;

(d) providing a substantially gas impervious furnace housing enclosing at least a portion of the heating chamber in a spaced apart relation with the sheathed gas permeable walls thereof to thereby provide an intermediate space therebetween;

(e) providing a highly porous particulate thermal insulating material positioned in the space intermediate said furnace housing and sheathed gas permeable walls of the heating chamber;

(f) supplying a relatively light weight gas into the heating area of the heating chamber to provide an atmosphere therein; and, (g) supplying a relatively heavy weight gas into the space intermediate said furnace housing and sheathed gas permeable walls of the heating chamber at a pressure greater than the pressure of the relatively lighter weight gas within the heating chamber area.

22. The method of claim 21, wherein the relatively light weight gas supplied into the heating chamber comprises ammonia, and the relatively heavy weight gas supplied into the space intermediate said furnace housing and gas permeable walls of the heating chamber comprises nitrogen.

* * * * *